US006035172A

United States Patent [19]

Mimura et al.

[11] Patent Number: 6,035,172

[45] Date of Patent: Mar. 7, 2000

[54] DEVELOPING ROLLER

[75] Inventors: Kazuyoshi Mimura; Yoshihisa Tawada; Kenji Kobayashi; Hiroshi Ogoshi; Susumu Fukuda, all of Otsu, Japan

[73] Assignee: Kaneka Corporation, Osaka, Japan

[21] Appl. No.: 09/171,669

[22] PCT Filed: Apr. 25, 1997

[86] PCT No.: PCT/JP97/01481

§ 371 Date: Oct. 23, 1998

§ 102(e) Date: Oct. 23, 1998

[87] PCT Pub. No.: WO97/41490

PCT Pub. Date: Nov. 6, 1997

[30] Foreign Application Priority Data

| | | | |
|---|---|---|---|
| Apr. 26, 1996 | [JP] | Japan | 8-106604 |
| Dec. 26, 1996 | [JP] | Japan | 8-348982 |
| Dec. 26, 1996 | [JP] | Japan | 8-348983 |

[51] Int. Cl.[7] ..... G03G 15/08

[52] U.S. Cl. ..... 399/286; 430/120

[58] Field of Search ..... 399/279, 286; 430/120

[56] References Cited

U.S. PATENT DOCUMENTS

| | | | |
|---|---|---|---|
| 4,505,573 | 3/1985 | Brewington et al. | 399/284 |
| 5,270,786 | 12/1993 | Kikuchi et al. | 399/286 |

FOREIGN PATENT DOCUMENTS

| | | |
|---|---|---|
| 62-82 | 1/1987 | Japan . |
| 63-189876 | 8/1988 | Japan . |
| 8-39699 | 2/1996 | Japan . |
| 8-44192 | 2/1996 | Japan . |

*Primary Examiner*—Joan Pendegrass
*Attorney, Agent, or Firm*—Armstrong, Westerman, Hattori, McLeland and Naughton

[57] ABSTRACT

Disclosed is a developing roller to be employed in a developing device which is incorporated in electrophotographic apparatus such as printers, duplicators, receivers for facsimiles or the like, and in which toner carried on the surface of the roller being or not being kept in contact with a photoreceptor is transferred at least to the photoreceptor. The developing roller is characterized in that an elastic conductive layer is formed around the conductive shaft of the roller, that the outer surface of the elastic conductive layer is covered with a surface layer, and that the surface layer is formed from a resin composition of which the contact angle with a drop of a liquid consisting essentially of a component similar to the resin component constituting the toner to be used in the developing device is not smaller than 35°. In the developing device, toner filming occurs little around the developing roller, and the initial density of the images formed is good. In addition, toner cracking occurs little in the developing device.

24 Claims, 2 Drawing Sheets

DEVELOPING ROLLER

FIELD OF THE INVENTION

The present invention relates to a developing roller employed in a developing device which is incorporated in electrophotographic apparatus such as duplicators, printers, receivers for facsimiles or the like, and precisely to a non-magnetic developing roller employed in a developing device in which toner carried on the surface of the roller being or not being kept in contact with a photoreceptor is transferred at least to the photoreceptor.

BACKGROUND OF THE INVENTION

Electrophotography is grouped into two types; in one type, employed are both magnetic working force and electric working force for the transference of developers, while in the other type, employed is only electric working force. In the former type where both magnetic working force and electric working force are employed, any of two-component developers comprising magnetic carrier and non-magnetic toner, or one-component developers comprising only magnetic toner may be used. As opposed to this, in the latter type where only electric working force is employed, one-component developers comprising only non-magnetic toner (hereinafter referred to as non-magnetic one-component developers) may be used.

FIG. 2 shows the constitution of a developing device and its peripheral devices in a printer or a duplicator in which is used a non-magnetic one-component developer. The illustrated constitution is first described below.

On the surface of a photoreceptor 1, which is an electrostatic latent image-carrying device, a photoconductive insulating layer is formed. The photoconductive insulator for the layer is a substance which is electrically insulating in ordinary condition but, when exposed to light, becomes conductive. The photoreceptor 1 rotates in the rotating direction 1*a*, and its surface is uniformly charged by the charger 2.

When the surface of an original manuscript is scanned with light, the surface of the photoreceptor 1 is exposed to the reflected light via an optical system (not shown) in the direction 10, whereupon the exposed site of the surface of the photoreceptor 1 becomes conductive to lose the charge, and an electrostatic latent image is formed on the surface of the photoreceptor 1. For example, in a laser printer, the exposure 10 is effected by optical beams of which the strength is modulated in accordance with the image to be recorded. In a duplicator, the reflected light that results from the optical scanning of the surface of an original manuscript is led to the surface of the photoreceptor 1 via an optical system, by which the surface of the photoreceptor 1 is exposed as in 10. When the charged powdery toner of a non-magnetic one-component developer is transferred by the developing roller 33 onto the electrostatic latent image formed on the surface of the photoreceptor 1, the latent image is developed into a visual image.

The toner having been transferred onto the surface of the photoreceptor 1 is further transferred onto recording paper 4. In this transferring step, electrostatic attraction is applied to the back surface of the recording paper 4 by means of the transfer device 5. A cleaning device 6 such as a cleaning blade or the like is disposed around the photoreceptor 1 in the site downstream the transfer device 5 in the rotating direction 1*a*. The cleaning device 6 is to remove the toner having been adsorbed on the surface of the photoreceptor 1 but not transferred onto the recording paper 4, from the surface of the photoreceptor 1.

The recording paper 4 onto which the toner has been transferred is conveyed to a fixing device 7. The fixing device 7 comprises a hot roller 8 and a pressure roller 9, between which the recording paper is passed so that the transferred toner is fixed on the recording paper 4.

The developing device 3 is so constructed that the toner container 31 that contains toner 12 therein is combined with the developing roller 33, in which the surface of the developing roller 33 is contacted with the photoreceptor 1 whereby the toner 12 is transferred onto the surface of the photoreceptor 1. The developing system of this type is referred to as a contact-type developing system. The toner container 31 has therein a supply roller 34 that acts for sufficient transference of the toner 12 onto the surface of the developing roller 33, and is provided with a thin layer-forming blade 36. The blade 36 is to control the thickness of the toner layer to be on the surface of the developing roller 33, and is kept in contact with the developing roller 33.

To the developing roller 33, negative voltage relative to the earth voltage is applied, for example, by means of a negative power source 37. To the supply roller 34, applied is negative voltage relative to the earth voltage, by means of a negative power source 38. The negative voltage applied to the supply roller 34 is larger than that applied to the developing roller 33 in terms of the absolute value. In that manner, the toner having adhered to and accumulated on the surface of the developing roller 33 is charged.

Another method is known for charging toner, in which the toner 12 is charged by the friction between the controller parts such as blades and rolls, and the surface of the developing roller 33 whereby the toner 12 is carried on the surface of the developing roller 12. In this case, where the toner 12 is charged in minus electricity, the surface layer of the developing roller 33 is to be made of a material selected from plus-charging materials in frictional electrification series. On the other hand, where the toner 12 is charged in plus electricity, the surface layer of the developing roller 33 is to be made of a material selected from minus-charging materials in frictional electrification series. Therefore, as the surface layer of most developing rollers widely used at present in the art, much used are nylon resins and urethane resins. Many patent applications for selective inventions from Japanese Patent Publication (JP-B) Sho-50-13661 have heretofore been filed, including, for example, Japanese Patent Application (JP-A) Sho-63-183470 relating to a surface layer that comprises an urethane and a reactive group-having fluorine compound; JP-A Sho-63-189876 relating to an alkali metal-containing urethane surface layer; JP-A Hei-1-252979 relating to an urethane surface layer that covers a conductive layer of oil-resistant rubber; JP-A Hei-3-249675 relating to a conductive filler that comprises an ester-type urethane and carbon black; JP-A Hei-5-158341 relating to an isocyanate-processed surface layer; JP-A Hei-7-54836 relating to a polyurethane surface layer as crosslinked with an amino resin; JP-A Hei-7-199645 relating to an urethane surface layer having a small degree of water absorption; JP-A Hei-7-310732 relating to an urethane-modified acrylic resin layer, etc.

The most important one of the characteristics which the surface layers such as those mentioned above of developing rollers are required to have is that the toner filming is few on those surface layers. At present, it is not too much to say that the toner filming determines the life of developing devices. The toner filming means filmy adhesion of toner not participating in development to the surfaces of developing rollers, and this has negative influences on images formed.

To prevent the toner filming on developing rollers, the toner releasability is specifically noted. For this, fluorine-containing particles are added to the surface layers of developing rollers, or urethane resins that contain fluorine-containing components, for example, cured products of fluorine-containing polyols and polyisocyanates are used for forming the surface layers.

However, as a result of our studies that are directed to solving the problem of toner filming on the surface layers of developer rollers on the basis of the toner releasability from developer rollers, we, the present inventors have found that the surface layers made of fluorine-containing resins or the like noted above are problematic in that the image density obtained is lowered even though the toner filming could be evaded. On the other hand, when the surface layers are made of nylon or the like resins in order to increase the image density, toner filming occurs thereon, resulting in that good images could not be obtained. Even when the surface layers are made of ester-type urethane resins, toner filming still occurs thereon.

Accordingly, the current techniques for preventing toner filming on developing rollers are not always satisfactory, and the toner filming is still a difficult problem.

SUMMARY OF THE INVENTION

In order to solve the problem noted above, we, the present inventors have tried selecting the material for the surface layers of developing rollers on the basis of the criterion of the contact angle of the surface layer with a drop of a liquid that consists essentially of a component similar to the resin component of toner, for the purpose of making the criterion for the toner releasability more realistic than that based on the friction coefficient of the surface layer or on the water contact angle thereof. As a result, we have found that the developing roller of which the surface layer is made of the specifically selected material suffers little from toner filming and that the toner chargeability on the developing roller is good to give good images. In addition, we have further found that when the surface layer of that type is combined with a soft and elastic conductive layer, the developing roller comprising the combination is effective for reducing toner cracking thereon, and the toner filming on the developing roller is much more reduced. On the basis of those findings, we have further studied and completed the present invention.

Specifically, the subject matter of the present invention is to provide a developing roller to be employed in a developing device which is incorporated in electrophotographic apparatus such as duplicators, printers, receivers for facsimiles or the like, and in which toner carried on the surface of the roller being or not being kept in contact with a photoreceptor is transferred at least to the photoreceptor; the developing roller being characterized in that an elastic conductive layer is formed around the conductive shaft of the roller, that the outer surface of the elastic conductive layer is covered with a surface layer, and that the surface layer is formed from a resin composition of which the contact angle with a drop of a liquid consisting essentially of a component similar to the resin component constituting the toner to be used in the developing device is not smaller than 35°.

DETAILED DESCRIPTION OF THE INVENTION

Figure 1:
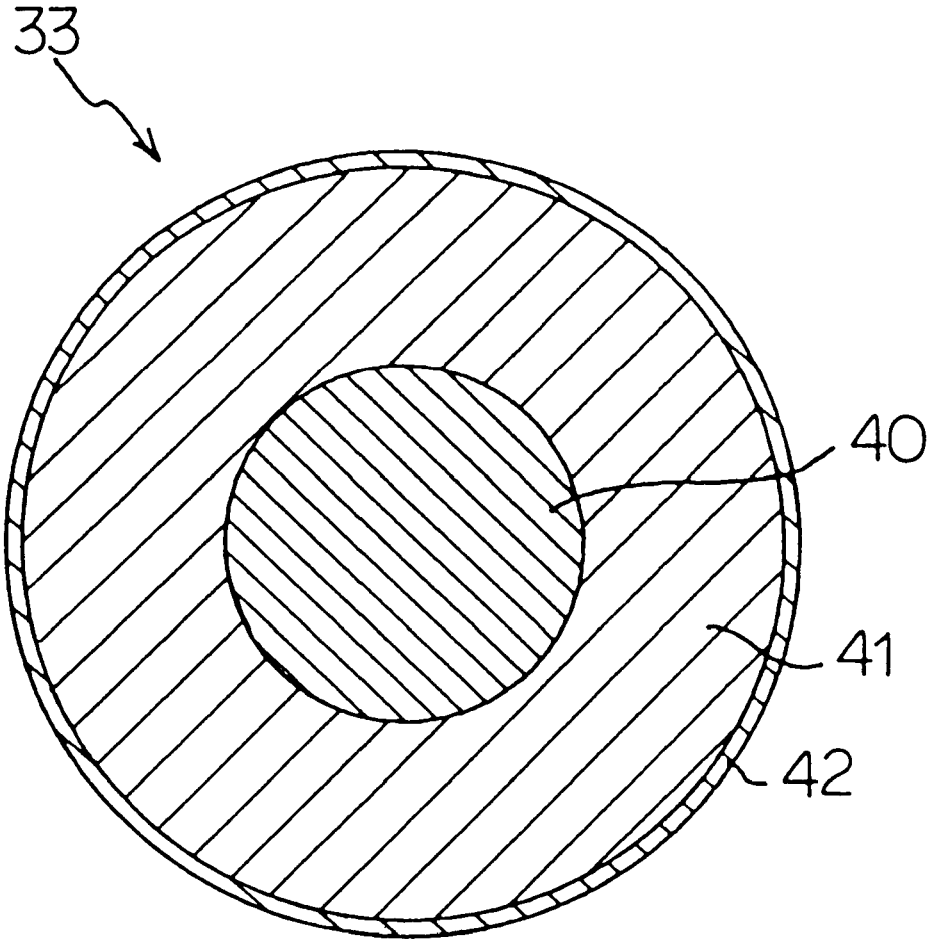
FIG. 1 is a graphical view showing the cross-sectional constitution of a developing roller.

The contact angle is preferably not smaller than 38°, more preferably not smaller than 42°.

The liquid consisting essentially of a component that is similar to the resin component of the toner to be used in developing devices is described below. Toner is produced by coating grains of color pigment with a thermoplastic resin such as a styrene-acrylic or polyester resin. The component that is similar to the resin component of toner indicates an acrylic compound for styrene-acrylic resin-containing toners, and indicates a polyester compound for polyester-containing toners.

For example, where polyester-containing toners are used in developing devices, a liquid polyester, concretely an adipic acid-type polyester having a viscosity at 25° C. and at 12 rpm of from 2700 to 3200 cps, an acid value of from 0.1 to 0.3 mg/g, and an APHA color hue of from 30 to 100 is used as the dripping liquid for the measurement of the contact angle therewith of the surface layer of the developing roller. On the other hand, where styrene-acrylic resin-containing toners are used in developing devices, butyl acrylate is used as the dripping liquid.

For measuring the contact angle as referred to herein, a resin composition for forming the surface layer of the developing roller of the invention is spread over a flat plate, the dripping liquid is dripped onto the resin layer formed on the plate, and, 30 seconds after the dripping, the contact angle between the drop of the liquid and the resin layer is measured. Concretely, for this, a measuring device of CA-DT·A Model manufactured by Kyowa Kaimen Kagaku KK is used; an injection needle of 15 gauges also manufactured by Kyowa Kaimen Kagaku KK is used through which the dripping liquid is dripped onto the resin layer; the size of the drop of the liquid in the dripping direction is 1.5 mm. As the flat plate, used is a Cr-plated flat plate, on which a layer of the resin composition for the surface layer of the developing roller is formed and baked. Five drops of the dripping liquid are dripped onto one sample of the resin layer at 23° C., and 30 seconds after the dripping, the contact angle between each drop and the resin layer is measured. The largest value and the smallest value of the five values thus measured are omitted, and the remaining three values of the contact angle are averaged. The averaged value is rounded off to the nearest integer number, which indicates the contact angle of the resin layer with the dripping liquid.

The resin composition of which the contact angle with the liquid polyester noted above is not smaller than 35° includes, for example, a resin composition consisting essentially of a polyether skeleton-having polyurethane compound; a resin composition consisting essentially of a mixture of a solvent-soluble fluorine-containing resin and an urethane resin, more preferably a polyether skeleton-having urethane resin, even more preferably in a ratio of the solvent-soluble fluorine-containing resin to the urethane resin falling between 10/90 and 90/10; and a resin composition consisting essentially of a polymer which has hydrolyzable silyl groups in the molecule and in which the repeating units constituting the main chain are of an acrylic polymer or a saturated hydrocarbon polymer.

The resin composition of which the contact angle with butyl acrylate is not smaller than 35° includes, for example, a resin composition consisting essentially of a polyether skeleton-having polyurethane compound; a resin composition consisting essentially of a mixture of a solvent-soluble fluorine-containing resin and an urethane resin, more preferably a polyether skeleton-having urethane resin, even more preferably in a ratio of the solvent-soluble fluorine-containing resin to the urethane resin falling between 10/90 and 90/10; and a resin composition consisting essentially of a polymer which has hydrolyzable silyl groups in the molecule and in which the repeating units constituting the main chain are of a saturated hydrocarbon polymer.

As the material for the elastic conductive layer of the developing roller of the invention, employable is any of ethylene-propylene (EP) rubber and polyether compounds. The characteristics which the material for the elastic conductive layer is required to have are, for example, that the layer made of the material has a low hardness, that the volume resistivity of the material itself is low and therefore the layer of the material can easily be made conductive, that the resin viscosity of the material is small, while the material is not cured, and therefore the material is easy to work, and that the material does not stain photoreceptors. The elastic conductive layer having a low hardness is advantageous in that, irrespective of the disposition of the developing roller that may be or may not be in contact with a photoreceptor in a developing device, toner cracking is retarded and even toner filming is also retarded. In addition, when the developing roller is in contact with a photoreceptor, the elastic conductive layer having a low hardness is further advantageous in that the nip width between the developing roller and the photoreceptor may be well large. from those viewpoints, it is desirable that the hardness of the elastic conductive layer is not larger than 30° in terms of the JIS A hardness.

As the material for the elastic conductive layer of which the hardness falls within the preferred range, preferred is a cured reaction pro duct of a curable composition consisting essentially of (A) a polymer having at least one alkenyl group in the molecule, in which the repeating units constituting the main chain are essentially oxyalkylene units or saturated hydrocarbon units, (B) a curing agent having at least 2 hydrosilyl groups in the molecule, and (C) a hydrosilylating catalyst, and optionally containing (D) a conductivity-imparting agent.

For the developing device into which the developing roller of the invention is incorporated and its peripheral devices, basically, any known constitution is employable except for the developing roller itself. For example, the same one as that illustrated in FIG. 2 may be employed.

Figure 2:
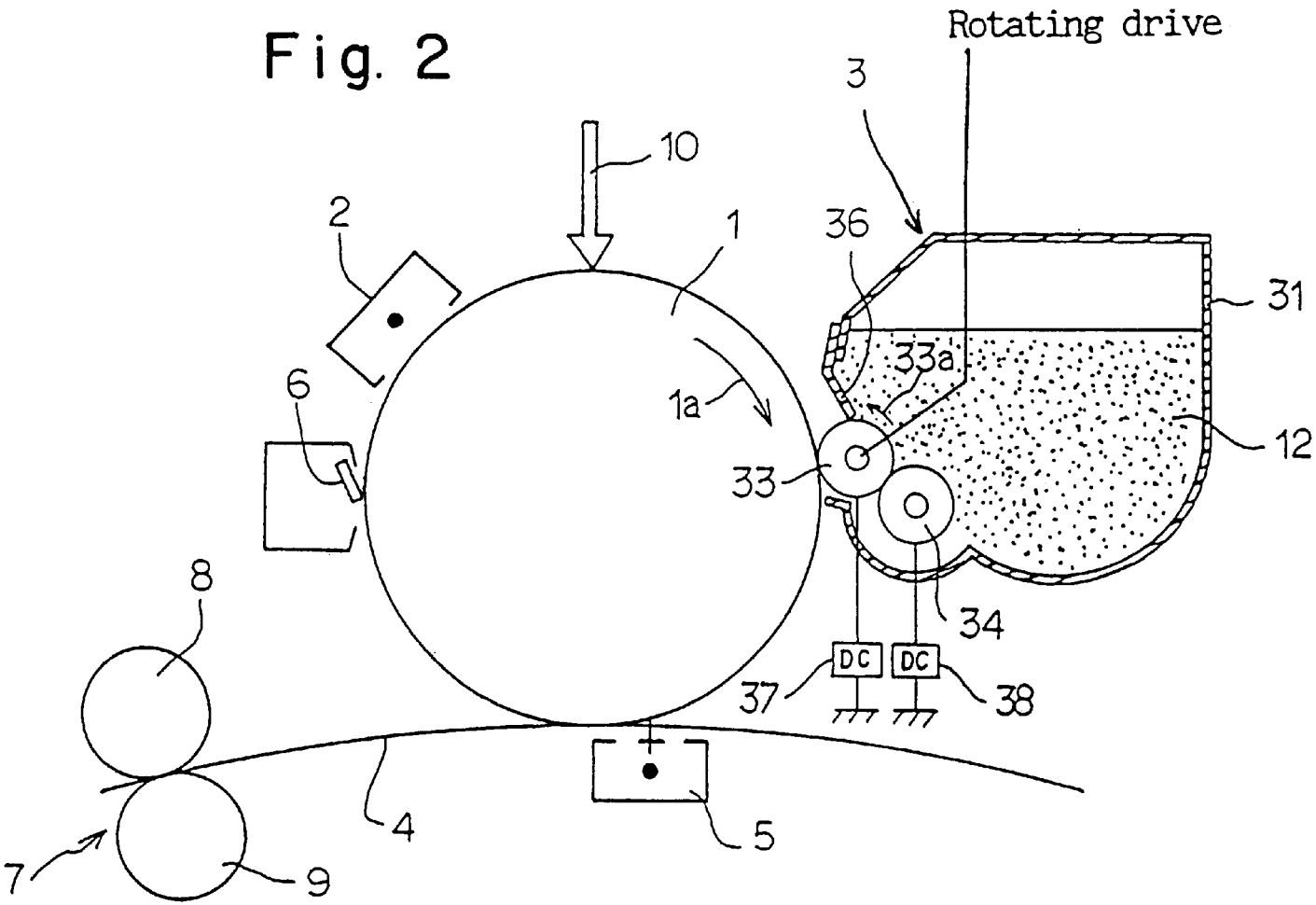
FIG. 2 is a graphical view showing one embodiment of a developing device and its peripheral constitution.

Now referred to is the system illustrated in FIG. 2, for describing the mechanism of the developing roller of the invention.

The developing device 3 in which toner is applied onto the surface of the photoreceptor 1 comprises the toner container 31 containing the powdery toner 12 therein. The toner container 31 has therein the developing roller 33 and the supply roller 34. The toner is prepared by coating color pigment grains with a thermoplastic resin such as a styrene-acrylic resin or a polyester resin, and has a grain size of about 10 $\mu$m or so. The supply roller 34 is to efficiently supply the toner to the surface of the developing roller 33. Using this facilitates smooth transfer of the toner 12 onto the developing roller 33, while making the thus-transferred toner charged. In the illustrated embodiment, a DC voltage falling between −150 and −350 V is applied to the developing roller 33 by means of the power source 37; while a DC voltage falling between −200 and −600 V is to the supply roller 34 by means of the power source 38. As the supply roller 34, employable is any of spongy conductive foam rollers or conductive cylinders such as metal pipes or the like. As the material for the supply roller 34, concretely mentioned are polyurethane, aluminium, etc.

Outside the developing roller 33, disposed is a blade 36, which is to control the thickness of the toner layer formed around the developing roller 33. Specifically, the edge of the blade 36 is contacted with the surface of the developing roller 33 that carries developing toner thereon, whereby the amount of the toner deposited on the surface of the developing roller 33 is controlled. In this embodiment illustrated, the edge of the blade 36 faces toward the direction opposite to the rotating direction 33*a* of the developing roller 33, which, however, is not specifically defined. The blade 36 is provided with a direct current-imparting means for imparting a predetermined amount of electricity to the toner which is between the developing roller 33 and the blade 36, by which the blade is charged to have a minus DC voltage falling between −150 and −600 V. Preferably, the blade 36 is made of a conductive material. Also preferably, the hardness of the material for the blade 36 is higher than that of the material for the developing roller 33.

The degrees of voltage concretely mentioned hereinabove for the developing roller 33, the supply roller 34 and the blade 36 are for minus-charging toner. As opposed to it, where plus-charging toner is used, the polarity of the voltage to be applied to those devices shall be opposite to that mentioned above. For any of minus-charging toner and plus-charging toner, the DC voltage to be applied to those devices may be combined with any AC voltage.

In a different means of charging the toner 12, the toner 12 may be electrically charged through friction between the developing roller 33 and the parts for controlling the roller 33, such as the other roller, the blade, etc.

FIG. 1 is a graphical view showing the outline of the cross-sectional constitution of the developing roller 33. The developing roller 33 comprises a conductive shaft 40 having a diameter of approximately from 1 to 12 mm, an elastic conductive layer 41 formed around the shaft 40, and a surface layer 42 that covers the outer surface of the roller 33.

In the illustrated embodiment, the elastic conductive layer 41 is a single-layered one. If desired, however, the layer 41 may have a laminate structure composed of a plurality of elastic layers each having a different hardness. Employing such a laminate structure as the layer 41, the overall conductivity and hardness of the developing roller 33 can be modulated.

The material for the conductive shaft 40 is not specifically defined. Employable is any metal shaft that is generally used in ordinary developing rollers. As examples, mentioned are iron or stainless steel shafts, as well as those plated with Ni or Cr. The diameter of the shaft 40 may fall between 1 and 12 mm or so.

The thickness and the hardness of the elastic conductive layer 41 that covers the conductive shaft 40 are not specifically defined. For example, as in ordinary developing rollers, the thickness may fall between 2 and 8 mm, preferably between 3 and 5 mm, and the hardness may fall between 3 and 80° in terms of JIS A hardness. However, in order to prevent toner cracking and in order not to damage the control blade for frictional electrification and also the photoreceptor, it is desirable that the layer 41 has a hardness of from 5 to 30° or so in terms of JIS A hardness. The JIS A hardness as referred to herein is measured as follows: A shaft-less cylinder sample having a diameter of 30 mm and a height of 12.7 mm is prepared from the material for the layer, and its hardness is measured at 23° C.

The details of the JIS A hardness will be further mentioned. A sample piece having a thickness of not smaller than 12 mm is mounted on a spring-type hardness tester, Model A, and the pressure surface of the tester is contacted with the test piece. In this condition, the pressing needle that is pushed down through the hole (the hole is formed in the center of the pressure surface) toward the test piece owing to the spring force applied to the needle is repelled back by the rubber force of the test piece, and the repelled distance is measured. From the thus-measured numerical value, obtained is the hardness of the test piece.

The surface layer 42 that covers the surface of the elastic conductive layer 41 is such that its contact angle with a drop of a liquid consisting essentially of a component similar to the resin component of the toner to be used in developing devices is not smaller than 35°. More preferably, the contact angle is not smaller than 38°, even more preferably not smaller than 42°.

Where polyester-containing toners are used in developing devices, a liquid polyester, concretely an adipic acid-type polyester having a viscosity at 25° C. and at 12 rpm of from 2700 to 3200 cps, an acid value of from 0.1 to 0.3 mg/g, and an APHA color hue of from 30 to 100 is used as the dripping liquid for the measurement of the contact angle therewith of the surface layer of the developing roller. The materials of which the contact angle as measured in that condition is not smaller than 35° are used for forming the surface layer of the developing roller.

Where styrene-acrylic resin-containing toners are used in developing devices, butyl acrylate is used as the dripping liquid for the measurement of the contact angle therewith of the surface layer of the developing roller. The materials of which the contact angle as measured in that condition is not smaller than 35° are used for forming the surface layer of the developing roller.

As one example of the resin composition of which the contact angle with a drop of the liquid polyester noted above is not smaller than 35°, mentioned is a resin composition consisting essentially of a polyether skeleton-having polyurethane compound.

As the polyether skeleton-having urethane resin, preferred are those containing a large amount of polypropylene glycol (PPG) component or a polytetramethylene glycol (PTMG) component. Desirably, for use in the invention, the resins contain the PPG component or the PTMG component in an amount of not smaller than 50% of the solid content. The urethane resin of that type is applied around the outer surface of a roll and dried thereon to form the surface layer of a developing roller. The means of coating the elastic conductive layer with the urethane resin to form the surface layer is not specifically defined. For example, a simple method may be employed for the formation, which comprises diluting the resin with a solvent having no active hydrogen group, such as methyl ethyl ketone, toluene or the like, then applying the resulting solution onto the surface of the elastic conductive layer through dipping, spraying or coating with rollers in accordance with the viscosity of the solution, and drying it at around 80° C. or so. In the last drying step, the resin layer may be partly crosslinked. Apart from this, another method may be employed, which comprises extruding an urethane elastomer into a pipe followed by inserting the elastic conductive layer-coated roller into the resulting pipe.

As another example of the resin composition for the surface layer, mentioned is a resin composition consisting essentially of a mixture of a solvent-soluble fluorine-containing resin and an urethane resin, more preferably a polyether skeleton-having urethane resin, even more preferably in a ratio of the solvent-soluble fluorine-containing resin to the urethane resin falling between 10/90 and 90/10.

In the resin composition consisting essentially of a mixture of a solvent-soluble fluorine-containing resin and an urethane resin, the solvent-soluble fluorine-containing resin is one which may be dissolved in DMF (dimethylformamide), DMAC (dimethylacetamide), NMP (methylpyrrolidone) or the like to form a coat layer by itself, and differs from fluorine-containing grains to be used as a filler or from fluorine-containing resins that react with urethane resins (for example, fluorine-containing polyol resins capable of reacting with isocyanate groups). For forming layers having a low hardness, the fluorine content of the solvent-soluble fluorine-containing resin is preferably lower. On the other hand, however, in view of the toner releasability of developing rollers having the layer of the composition, the fluorine content of the resin is preferably higher. Therefore, taking those into con sideration along with the hardness of the underlying elastic layer, the most balanced fluorine content of the resin may be selected. In the resin composition, the urethane resin is not specifically defined. Those having a larger urethane bond content will form a surface layer of which the ability to charge toner is higher. However, the layer of those resins will be stiff. In order to form a surface layer having a lower hardness, preferred are polyether skeleton-having urethane resins. For thermosetting resins, it is desirable that the molecular weight between the crosslinking points therein is larger since the layer of the resins of that type may have a lower hardness.

The ratio of the solvent-soluble fluorine-containing resin to the urethane resin in the composition must be such that the two are in an amount of not smaller than 10 parts by weight each, preferably not smaller than 20 parts by weight each, relative to 100 parts by weight of the sum of the two. If the ratio of the solvent-soluble fluorine-containing resin is smaller than 10 parts by weight, such is unfavorable since the surface roughness of the layer formed will be large and since the environment-dependency of the electric resistance of the layer will be large. On the other hand, if the ratio of the urethane resin is smaller than 10 parts by weight, the thickness of the surface layer to be formed must be reduced in order to prevent the increase in the electric resistance of the layer. If so, such a thin layer will have pin holes, or its chargeability for minus-charging toner is poor, resulting in that uneven images will be formed. In order to stably compensate for the drawbacks of the two resins, it is desirable that both the solvent-soluble fluorine-containing resin and the urethane resin are in an amount of not smaller than 20 parts by weight each in the resin composition. If desired, the resin composition may additionally contain any other components, for example, a conductivity-imparting agent such as carbon black or the like, in addition to the solvent-soluble fluorine-containing resin and the urethane resin. The surface layer of the developing roller of the invention may be formed by mixing a fluorine-containing resin solution as prepared by dissolving the solvent-soluble fluorine-containing resin in a solvent, and an urethane resin solution as prepared by dissolving the urethane resin in a solvent, in a ratio of the two resins falling between 10/90 and 90/10, then applying the resulting resin mixture solution onto the outer surface of the roller, and drying it thereon.

As still other examples of the resin composition for the surface layer, mentioned are a resin composition consisting essentially of a polymer which has hydrolyzable silyl groups in the molecule and in which the repeating units constituting the main chain are of an acrylic polymer; and a resin composition consisting essentially of a polymer which has hydrolyzable silyl groups in the molecule and in which the repeating units constituting the main chain are of a saturated hydrocarbon polymer.

In the former resin composition consisting essentially of a polymer which has hydrolyzable silyl groups in the molecule and in which the repeating units constituting the main chain are of an acrylic polymer, the hydrolyzable silyl groups are in the main chain of the polymer as formed through copolymerization of alkoxysilyl groups and acrylic monomers.

It is desirable that the polymer has at least 2 hydrolyzable silyl groups in one molecule, preferably at least at the both terminals of the polymer, in view of its uniform and good crosslinkability. Where three trimethoxysilyl groups exist at the both terminals of the molecule of the polymer, the polymer shall have 6 reactive points. Taking the 6 trimethoxysilyl groups existing at the both terminals in the polymer into consideration, it is desirable that the number of the alkoxysilyl groups to be in one molecule of the polymer is from 2 to 50, preferably from 4 to 30, more preferably from 6 to 10, since the polymer having the constitution could easily take a good network structure. The molecular weight of the polymer is, before being cured, preferably from 1000 to 25000, more preferably from 2000 to 20000 in terms of the number-average molecular weight. The acrylic monomers for the polymer are not specifically defined. However, one typical example of the polymer is a copolymer consisting essentially of methyl methacrylate (MMA) as the hard segment and butyl acrylate (BA) as the soft segment. The polymer may partly contain, in its main chain or side chains, urethane bonds or siloxane bonds.

In the resin composition consisting essentially of a polymer which has hydrolyzable silyl groups in the molecule and in which the repeating units constituting the main chain are of a saturated hydrocarbon polymer, the hydrolyzable silyl groups are in the main chain of the polymer as formed through polymerization of saturated hydrocarbon units.

As typical examples of the polymer of saturated hydrocarbon units, which is for the repeating units constituting the main chain, mentioned are isobutylene polymers, hydrogenated isoprene polymers, and hydrogenated butadiene polymers. These polymers may be in the form of copolymers having repeating units of any other comonomers, but it is important that they contain saturated hydrocarbon units in an amount of not smaller than 50%, preferably not smaller than 70%, more preferably not smaller than 90%, in order that they do not lose the characteristic of low water absorbability of saturated hydrocarbon polymers.

Regarding their molecular weight, it is preferable that the saturated hydrocarbon polymers have a number-average molecular weight (Mn) of from 500 to 50000 or so, more preferably from 1000 to 15000 or so, in view of the easiness in handling them. Even more preferably, they have a number-average molecular weight of from 3000 to 5000 or so, in view of the fact that the surface layer comprising them is soft to such a degree that it does not cause toner cracking thereon and the fact that it is not sticky and its surface is not stained. Further preferably, the saturated hydrocarbon polymers are liquid to have fluidity at room temperature, in view of the easiness in working them.

Regarding the hydrolyzable silyl groups to be in the polymer which has hydrolyzable silyl groups in the molecule and in which the repeating units constituting the main chain are of a saturated hydrocarbon polymer, the same as those for the acrylic main chains mentioned above shall apply thereto.

The resin composition for the surface layer, of which the contact angle with a drop of butyl acrylate is not smaller than 35° includes, for example, the resin composition consisting essentially of a polyether skeleton-having polyurethane compound; the resin composition consisting essentially of a mixture of a solvent-soluble fluorine-containing resin and an urethane resin, more preferably a polyether skeleton-having urethane resin, even more preferably in a ratio of the solvent-soluble fluorine-containing resin to the urethane resin falling between 10/90 and 90/10; and the resin composition consisting essentially of a polymer which has hydrolyzable silyl groups in the molecule and in which the repeating units constituting the main chain are of a saturated hydrocarbon polymer, all mentioned in detail hereinabove.

The thickness of the surface layer may fall between 5 and 300 μm, preferably between 10 and 150 μm. Where the surface layer has a thickness larger than 100 μm, it is desirable that a conductivity-imparting agent such as carbon black or the like is added thereto for the purpose of reducing the resistance of the roller. It is desirable that the hardness of the surface layer is not larger than 50° in terms of JIS A hardness, considering the fact that the hardness of the underlying elastic conductive layer is preferably not larger than 30° in terms of JIS A hardness.

The developing roller 33 is so defined that its overall resistance falls between $10^3$ and $10^8$ Ω or so, but preferably between $10^4$ and $10^7$ Ω or so.

The roller resistance is measured by applying a direct voltage of 100 V to the roller with applying a load of 500 g to the both ends of the conductive shaft of the roller.

Hereinunder described in detail is the material for the elastic conductive layer 41.

The material for the elastic conductive layer 41 includes, for example, EP rubber, polyether compounds, etc., for which may be used a conductive or semiconductive resin composition containing a reactive organic material. The resin composition of that type is hereinunder generically referred to as a conductive composition.

As examples of the conductive composition, mentioned are those containing, as the essential component, a reactive organic material of any of oxyalkylene-type, saturated hydrocarbon-type, urethane-type or siloxane-type polymers. The reactive organic material in the composition, which is liquid before being cured, is solidified into a solid after having been cured. Of those, especially preferred are oxyalkylene-type polymers for the reasons that the composition comprising them may be formed into a layer having a low hardness with ease, that the composition itself has low a volume resistivity and therefore can be easily made conductive, that the resin viscosity of the composition not cured is small and the composition is easy to work, and that the layer of the composition hardly stains photoreceptors. Also preferred are hydrocarbon-type polymers for the reasons that the composition comprising them has a low degree of water absorbability and that the resistance of falling between $10^3$ and $10^8$ Ω of the roller that has a layer of the composition is influenced little by the environmental change. The curing reaction for the composition includes, for example, reaction at the site of isocyanate groups such as urethanation, ureation or the like, as well as hydrosilylation, hydrolytic condensation, etc. Of those, preferred is hydrosilylation, since it causes little curing shrinkage and the curing time for it is short. In particular, cured products of a curable composition consisting essentially of (A) a polymer having at least one alkenyl group in the molecule, in which the repeating units constituting the main chain are essentially oxyalkylene units or saturated hydrocarbon units, (B) a curing agent having at least 2 hydrosilyl groups in the molecule, and (C) a hydrosilylating catalyst, and optionally containing (D) a conductivity-imparting agent are advantageous in that their hardness is low and their compression set is small even though no plasticizer is added thereto, and that they have a low volume-intrinsic resistivity and therefore require only a small amount of a conductivity-imparting agent, if added thereto.

The oxyalkylene-type curable composition is referred to as conductive composition (1), while the saturated hydrocarbon-type curable composition is as conductive composition (2), and those compositions (1) and (2) will be described in detail hereinunder.

First mentioned is the composition comprising the oxyalkylene-type, reactive organic material.

The oxyalkylene-type conductive composition (1) is a curable composition consisting essentially of:

(A-1) a polymer having at least one alkenyl group in the molecule, in which the repeating units constituting the main chain are essentially olyalkylene units, (B) a compound having at least 2 hydrosilyl groups in the molecule (curing agent), and (C) a hydrosilylating catalyst, and optionally containing;

(D) a conductivity-imparting substance.

As mentioned hereinabove, the conductive composition (1) is characterized in that it may be formed into a layer having a low hardness with ease, that it has low a volume resistivity and therefore can be easily made conductive, that the resin viscosity of the composition not cured is small and the composition is easy to work, and that the layer of the composition hardly stains photoreceptors. Where the volume resistivity of the conductive composition is intended to fall within a semiconductive range, -the composition may not require the component (D).

The component (A-1) cures through hydrosilylation with the component (B). As having at least one alkenyl group in its molecule, the component (A-1) hydrosilylaten with the component (B) and cures to have an increased molecular weight.

The component (A-1) must have at least one alkenyl group, as it hydrosilylates with the component (B). From the viewpoint of the rubber-like elasticity of its cured product, it is desirable that the component (A-1) has two alkenyl groups at its both terminals when it has a linear structure and that it has two or more alkenyl groups at its molecular terminals when it has a branched structure.

The repeating units constituting the main chain of the component (A-1) are oxyalkylene units. The polymer of that type for the component (A-1) is favorable, since the volume resistivity of the cured product of the polymer may be from $10^6$ to $10^9$ Ω·cm when only a small amount of the component (D) is added to the polymer.

As the component (A-1), preferred is an oxyalkylene polymer in which the main repeating units constituting the main chain are oxyalkylene units, more preferably an oxypropylene polymer in which the main repeating units constituting the main chain are oxypropylene units.

The oxyalkylene polymer is meant to indicate a polymer in which at least 30%, preferably at least 50% of the units constituting the main chain are oxyalkylene units. The other units which the polymer may have in addition to the oxyalkylene units are those of compounds having 2 or more active hydrogens, which are used as the starting substances for producing the polymer through polymerization. The compounds include, for example, ethylene glycol, bisphenolic compounds, glycerin, trimethylolpropane, pentaerythritol, etc. The oxypropylene polymer may be a copolymer (including graft copolymers), which comprises additional units from ethylene oxide, butylene oxide, etc.

Regarding the molecular weight of the oxyalkylene polymer for the component (A-1) noted above, it is preferable that the polymer has a number-average molecular weight (Mn) of from 500 to 50,000, more preferably from 1,000 to 40,000, from the viewpoint of improving the balance of the reactivity of the polymer and the low hardness of the cured product of the polymer. Especially preferably, the polymer has a number-average molecular weight of not smaller than 5,000, even more preferably from 5,000 to 40,000. If the number-average molecular weight of the polymer is smaller than 500, the curable composition comprising the polymer could hardly give, after having been cured, a cured product having good mechanical characteristics (rubber-like hardness, elongation). On the other hand, however, if the number-average molecular weight of the polymer is too large, the molecular weight of each segment for one alkenyl group of the polymer will be large and the reactivity of the polymer is lowered due to the steric hindrance occurring in the molecule, thereby often resulting in that the polymer could not cure sufficiently. If so, in addition, the viscosity of the polymer composition will be too high, and the workability thereof is thereby worsened.

The alkenyl groups to be in the oxyalkylene polymer are not specifically defined, but preferred are those of the following general formula (1), in view of the excellent curability of the polymer comprising them.

$$H_2C{=}C(R^1)— \quad (1)$$

wherein $R^1$ represents a hydrogen atom or a methyl group.

The oxyalkylene polymer into which the alkenyl groups such as those mentioned above are not as yet introduced can be obtained through ordinary polymerization of alkylene oxides (anionic polymerization using caustic alkali) or through chain extension of the polymers as obtained in such ordinary polymerization. Oxyalkylene polymers having functional groups and having a higher molecular weight and a narrower molecular weight distribution can be produced according to the methods described in JP-A Sho-61-197631, Sho-61-215622, Sho-61-215623, Sho-61-218632, and JP-B Sho-46-27250, Sho-59-15336, etc.

One characteristic of the curable composition (1) is that it is easy to lower the hardness of the cured product of the composition. For this characteristic, it is desirable that the polymer for the component (A-1) in the composition (1) shall have at least 2 alkenyl groups at its molecular terminals. If the number of the alkenyl groups existing in the polymer is too large relative to the molecular weight of the polymer, the cured product will be too stiff and could not have good rubber-like elasticity.

As typical examples of the component (A-1), mentioned are the compounds of the following chemical formulae (2) to (5):

$$[H_2C{=}C(R^2)—R^3—O]b—R^4 \quad (2)$$

wherein $R^2$ represents a hydrogen atom or a methyl group; $R^3$ represents a divalent hydrocarbon group having from 1 to 20 carbon atoms and optionally having at least one ether group, preferably an alkylene group; $R^4$ represents an oxyalkylene polymer residue; and b represents an integer of 1 or more.

$$[H_2C{=}C(R^5)—R^6—O—CO]b—R^7 \quad (3)$$

wherein $R^5$ represents a hydrogen atom or a methyl group; $R^6$ represents a divalent hydrocarbon group having from 1 to 20 carbon atoms and optionally having at least one ether group, preferably an alkylene group; $R^7$ represents an oxyalkylene polymer residue; and b represents an integer of 1 or more.

$$[H_2C{=}C(R^8)]b{-}R^9 \quad (4)$$

wherein $R^8$ represents a hydrogen atom or a methyl group; $R^9$ represents an oxyalkylene polymer residue; and b represents an integer of 1 or more.

$$[H_2C{=}C(R^{10}){-}R^{11}{-}OCOO]b{-}R^{12} \quad (5)$$

wherein $R^{10}$ represents a hydrogen atom or a methyl group; $R^{11}$ represents a divalent hydrocarbon group having from 1 to 20 carbon atoms and optionally having at least one ether group, preferably an alkylene group; $R^{12}$ represents an oxyalkylene polymer residue; and b represents an integer of 1 or more.

The component (B) in the conductive composition (1) is not specifically defined, provided that it is a compound having at least 2 hydrosilyl groups in the molecule. However, if the number of the hydrosilyl groups existing in the compound for the component (B) is too large, many hydrosilyl groups will remain in the cured product, often causing voids and cracks of the layer formed. Therefore, it is desirable that the number of the hydrosilyl groups to be in the molecule of the compound is not larger than 50, more preferably from 2 to 30, even more preferably from 2 to 20, in view of the easiness in controlling the rubber-like elasticity of the cured product and of the storage stability of the composition. In addition, in order to easily prevent the composition from foaming in the step of curing the composition, it is desirable that the number of the hydrosilyl groups to be in the polymer is at most 20. On the other hand, in order to prevent curing failure even when the hydrosilyl groups are inactivated, it is desirable that the number of the hydrosilyl groups to be in the polymer is at least 3. The most preferred range of the number of the hydrosilyl groups in the polymer falls between 3 and 20.

The wording "having one hydrosilyl group" as referred to herein is meant to indicate the case having one H as bonded to Si. To that effect, therefore, the case of $SiH_2$ is to have two hydrosilyl group. For H to be bonded to Si in the curing agent (B), it is desirable that plural H's are bonded to different Si's, since the ability of the curing agent (B) having that molecular constitution is higher and since the cured product has better rubber-like elasticity.

Considering the dispersibility of the conductivity-imparting agent (component (D)) in the composition and the workability of the composition into the layer of the roller, it is desirable that the component (B) has a number-average molecular weight of not larger than 30,000, more preferably not larger than 20,000, evenmore preferably not larger than 15,000. Further considering the reactivity and the compatibility of the component (B) with the component (A), it is more desirable that the number-average molecular weight of the component (B) falls between 300 and 10,000.

As typical examples of the component (B), mentioned are compounds of the following general formulae (6) to (8), which have hydrosilyl group-containing cyclic siloxanes at the molecular terminals.

(6)

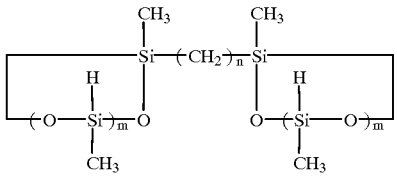

wherein n represents an integer of from 5 to 12; and m represents an integer of from 2 to 4.

(7)

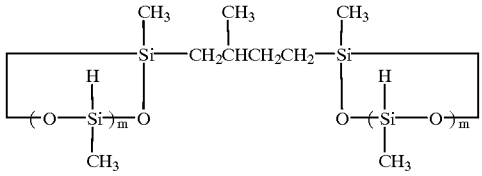

wherein m represents an integer of from 2 to 4.

(8)

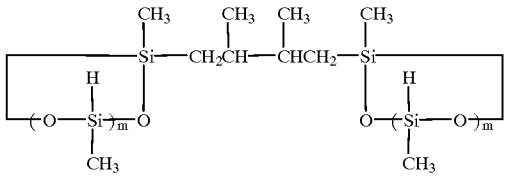

wherein m represents an integer of from 2 to 4.

In the compounds of formulae (6) to (8) noted above, hydrosilyl group-containing cyclic siloxanes are bonded to the both terminals of a molecule having a relatively low molecular weight. Apart from those, also employable herein are any other compounds having hydrosilyl group-containing cyclic siloxanes at the terminals of a polymer molecule or even a branched polymer molecule having a high molecular weight.

As other examples of the component (B), further mentioned are linear or cyclic polyorganohydrogensiloxanes (including polyoxyalkylene-modified, styrene-modified and olefin-modified derivatives), such as those of the following chemical formulae (9) to (11).

(9)

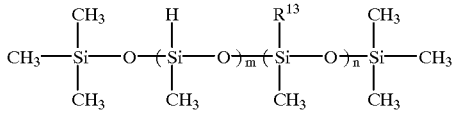

wherein m and n each are an integer, and $10 \leqq m+n \leqq 50$, $2 \leqq m$, and $0 \leqq n$; and $R^{13}$ represents a methyl group, a polyoxyalkylene group having a molecular weight of from 100 to 10,000, or a hydrocarbon group having from 2 to 20 carbon atoms, which may have one or more phenyl groups, and plural $R^{13}$'s, if any, are not needed to be all the same.

(10)

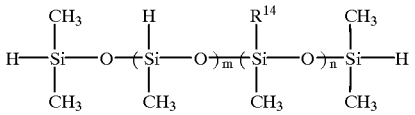

wherein m and n each are an integer, and $10 \leqq m+n \leqq 50$, $2 \leqq m$, and $0 \leqq n$; and $R^{14}$ represents a methyl group, a polyoxyalkylene group having a molecular weight of from 100 to 10,000, or a hydrocarbon group having from 2 to 20 carbon atoms, which may have one or more phenyl groups, and plural $R^{14}$'s, if any, are not needed to be all the same.

(11)

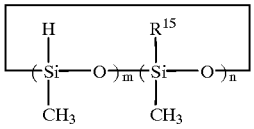

wherein m and n each are an integer, and $3 \leqq m+n \leqq 20$, $2 \leqq m \leqq 19$, and $0 \leqq n \leqq 18$; and $R^{15}$ represents a methyl group, a polyoxyalkylene group having a molecular weight of from 100 to 10,000, or a hydrocarbon group having from 2 to 20 carbon atoms, which may have one or more phenyl groups, and plural $R^{15}$'s, if any, are not needed to be all the same.

Regarding the component (B), the aggregating force of the component (A) is larger than that of the component (B). Therefore, in view of the compatibility of the two components (A) and (B), it is important that the component (B) is modified with any phenyl group-having modifier. Considering their compatibility with the component (A) and even their easy availability, preferred are styrene-modified derivatives. From their storage stability, more preferred are α-methylstyrene-modified derivatives.

The hydrosilylating catalyst of the component (C) is not specifically defined, so far as it is active in catalyzing hydrosilylation. For example, it includes a simple substance of platinum; solid platinum as carried on a simple substance of alumina or the like; chloroauric acid (including its complexes with alcohols); various complexes of platinum; chlorides of metals such as rhodium, ruthenium, iron, aluminium, titanium and the like. Of those, preferred are chloroauric acid, platinum-olefin complexes and platinum-vinylsiloxane complexes, in view of their catalytic activity. These catalysts may be used either singly or as combined.

The conductivity-imparting agent of the component (D) includes, for example, carbon black, fine metal powder, and even compounds having conductive units, such as typically organic compounds and polymers having any of quaternary ammonium base groups, carboxylic acid groups, sulfonic acid groups, sulfate ester groups, phosphate ester groups and the like, as well as ether-ester amides or ether-imide polymers, ethylene oxide-epihalohydrin copolymers, methoxypolyethylene glycol acrylates, etc.; and also compounds capable of imparting electroconductivity to non-conductive substances, such as antistatic agents of polymer compounds, etc. These conductivity-imparting agents can be used either singly or as combined.

The ratio of the component (A-1) to the component (B) in the conductive composition (1) noted above is preferably such that the amount of the hydrosilyl groups in the component (B) is from 0.2 to 5.0 mols, more preferably from 0.4 to 2.5 mols, relative to one mol of the alkenyl group in the component (A-1), in order that the hardness of the elastic conductive layer to be formed from the composition could be low.

The amount of the component (C) to be in the conductive composition (1) is preferably from $10^{-8}$ to $10^{-1}$ mols, more preferably from $10^{-6}$ to $10^{-1}$ mols, even more preferably from $10^{-6}$ to $10^{-3}$ mols, relative to one mol of the alkenyl group in the component (A-1). If the amount of the component (C) is smaller than $10^{-8}$ mols, the intended reaction does not occur. On the other hand, hydrosilylating catalysts are generally expensive and corrosive, and, in addition, they produce a large amount of hydrogen gas to foam cured product. Therefore, using too much hydrosilylating catalyst over $10^{-1}$ mols is undesirable.

The other saturated hydrocarbon-type conductive composition (2) for use in the invention is a curable composition consisting essentially of:

(A-2) a polymer having at least one alkenyl group in the molecule, in which the repeating units constituting the main chain are saturated hydrocarbon units, (B) a curing agent having at least 2 hydrosilyl groups in the molecule, and (C) a hydrosilylating catalyst, and optionally containing;

(D) a conductivity-imparting substance.

Of those constituting the composition (2), the components (B) to (D) are the same as those in the conductive composition (1) mentioned above. Only the component (A-2) in the composition (2) that is different from the component (A-1) in the composition (1) will be mentioned below.

Like the component (A-1), the component (A-2) also cures through hydrosilylation with the component (B). As having at least one alkenyl group in its molecule, the component (A-2) hydrosilylates with the component (B) and cures to have an increased molecular weight.

The component (A-2) must have at least one alkenyl group, as it hydrosilylates with the component (B). From the viewpoint of the rubber-like elasticity of its cured product, it is desirable that the component (A-2) has two alkenyl groups at its both terminals when it has a linear structure. When the component (A-2) has a branched structure, it is also desirable that it has two or more alkenyl groups at its molecular terminals.

The repeating units constituting the main chain of the component (A-2) are saturated hydrocarbon units. As typical examples for the units, mentioned are isobutylene polymers, hydrogenated isoprene polymers, and hydrogenated butadiene polymers. These polymers may be copolymerized with any other comonomers to have repeating units of such comonomers. However, it is important that the main chain of the component (A-2) has at least 50%, but preferably at least 70%, more preferably at least 90% of saturated hydrocarbon units, in order not to detract from the characteristic of low water absorbability of the saturated hydrocarbon-type polymers for the component (A-2).

Regarding the molecular weight of the saturated hydrocarbon-type polymer for the component (A-2), it is preferable that the polymer has a number-average molecular weight (Mn) of from 500 to 50,000 or so, more preferably from 1,000 to 15,000 or so, from the viewpoint of the easiness in handling it. Further preferably, the polymer is liquid and had fluidity at room temperature, in view of its workability.

The method for introducing alkenyl groups into the component (A-2) is not specifically defined. Alkenyl groups may be introduced thereinto during or after polymerization to form the polymer of the component (A-2).

As preferred examples of the saturated hydrocarbon-type polymers having at least one alkenyl group in the molecule, in which the repeating units constituting the main chain are saturated hydrocarbon units, mentioned are linear polyisobutylene polymers, hydrogenated polybutadiene polymers and hydrogenated polyisoprene polymers having 2 alkenyl groups at their both terminals and having a number-average molecular weight (Mn) of from 2000 to 15000 and a ratio Mw/Mn that falls between 1.1 and 1.2.

The component (B) of a curing agent having at least 2 hydrosilyl groups in the molecule, which is in the conductive composition (2), acts on the component (A-2) to cure it.

The components (B), (C) and (D) in the conductive composition (2) may be the same as those in the conductive composition (1) mentioned above.

The oxyalkylene-type conductive composition (1) and the saturated hydrocarbon-type conductive composition (2), which are preferred examples of the resin composition to form the elastic conductive layer of the developing roller of the invention are described in detail hereinabove. Further details of those compositions are referred to in U.S. Pat. No. 5,409,995, and JP-A Hei-3-95266 and Hei-6-256634.

One specific embodiment of the conductive composition (1) or (2) comprising the components (A-1) to (D) or the components (A-2) to (D), respectively, noted above is a curable composition comprising;

(A) a polyisobutylene, hydrogenated polybutadiene, hydrogenated polyisoprene or polyoxypropylene having a number-average molecular weight (Mn) of from 2,000 to 15,000 and having 2 alkenyl groups at its both terminals, (B) a hydrocarbon-type curing agent having cyclic hydrogenpolysiloxanes at its both terminals, or a linear or cyclic polyorganohydrogensiloxane (optionally partly modified with styrenes), in an amount of from 0.7 to 1.4 mols in terms of the SiH group content, relative to 1 mol of the alkenyl group in the component (A), (C) a hydrosilylating catalyst of chloroauric acid ($H_2PtCl_2$) or its alcoholic solution, in an amount of from $10^{-6}$ to $10^{-3}$ mols of the acid, relative to 1 mol of the alkenyl group in the component (A), and (D) ketjen black or acetylene black in an amount of from 0 to 15% relative to the total amount of the components (A), (B) and (C).

The conductive compositions (1) and (2) comprising the components (A) to (D) noted above may optionally contain an additional component (E) of a storage stability improver, which is to improve the storage stability of the compositions.

As the component (E), employable is any one known as the storage stabilizer for the component (B) Preferred examples of the component (E) include compounds having aliphatic unsaturated bonds, organic phosphorus compounds, organic sulfur compounds, nitrogen-containing compounds, tin compounds, organic peroxides, etc. As specific examples of those compounds, mentioned are benzothiazole, thiazole, dimethyl maleate, dimethylacetylene-dicarboxylates, 2-pentene-nitrile, 2,3-dichloropropene, quinoline, etc., which, however, are not limitative. Of those, preferred are thiazole, benzothiazole and dimethyl maleate in view of their capabilities to prolong the pot life of the composition and to enhance the rapid curability thereof.

The storage stability improvers noted above may be used either singly or as combined.

The amount of the component (E) to be in the curable composition may be nearly freely determined so far as it uniformly disperses in the components (A) and (B) Preferably, however, the amount falls between $10^{-6}$ and $10^{-1}$ mols relative to one mol of the SiH-containing compound of the component (B). If the amount of the component (E) is smaller than $10^{-6}$ mols, the storage stability of the component (B) could not be sufficiently improved. On the other hand, if the amount is larger than $10^{-1}$ mols, the curability of the composition will be retarded.

The conductive compositions (1) and (2), and even those additionally containing the storage stability improver rapidly cure through the reaction of the alkenyl groups and the hydrosilyl groups therein, and the resulting cured products have a small amount of volatiles. In particular, when the conductive composition (1) contains, as the essential component (A-1), an oxypropylene polymer (in an amount of from 60 to 98%, but preferably from 90 to 97% relative to the cured product), its cured product could be a conductive or semiconductive one having a volume resistivity of from $10^3$ to $10^9$ Ω·cm or so, even when a small amount of the component (D) is added thereto. In addition, the cured product is characterized by having good rubber-like elasticity even at low temperatures.

The conductive composition (1) or (2) comprising the components (A) to (D) noted above may be introduced into a mold having therein a SUS shaft as disposed in its center, for example, through casting, injection or extrusion thereinto, and then cured therein under heat at a temperature falling between 30 and 150° C. or so, preferably between 80 and 140° C. or so, for a period of time falling between 10 seconds and 1 hour or so, preferably between 1 and 20 minutes or so, whereby is formed an elastic conductive layer of the composition around the shaft. After having been semi-cured, the composition may be post-cured.

Where such an elastic conductive layer is formed from the curable composition of that type around the shaft of a developing roller, it is important that, when the finished developing roller is built in a developing device, the nip width between the developing roller and the control blade and that between the developing roller and the photoreceptor in the device are not smaller than predetermined ones. From the viewpoint that the finished developing roller satisfies the intended nip widths, it is desirable that the hardness of the cured product of the composition is not larger than 40°, preferably not larger than 30°, in terms of JIS A hardness, and that the amount of the component (B) in the composition is from 0.2 to 2.5 mols, preferably from 0.4 to 2.5 mols in terms of the hydrosilyl group therein relative to one mol of the alkenyl group in the component (A).

In still another embodiment, an urethane-type reactive organic material may be in the conductive composition for the elastic conductive layer of the developing roller of the invention. The conductive composition of this type is hereinunder referred to as conductive composition (3), which will be described in detail.

One preferred example of the conductive composition (3) that contains an urethane-type reactive organic material is a curable composition consisting essentially of;

(F) a polymer having at least one active hydrogen group in the molecule, in which the repeating units constituting the main chain are oxyalkylene or polyester units, (G) a compound having at least 2 isocyanate groups in the molecule, (H) a polyurethanating catalyst, and optionally containing;

(D) a conductivity-imparting agent.

Where the volume resistivity of the conductive composition is intended to fall within a semiconductive range, the composition may not require the component (D).

If desired, the conductive composition (3) may optionally contain a plasticizer or the like. Also if desired, the same additives as those in the conductive compositions (1) and (2) noted above may be added to the composition (3).

The component (F) reacts with the component (G) and cures. Specifically, as having at least one active hydrogen group in one molecule, the component (F) reacts with the component (G) for polyurethanation and cures, and the resulting cured product has an increased molecular weight.

Since the component (F) reacts with the component (G) for polyurethanation, it must have at least one active hydrogen group, but preferably from 2 to 5 active hydrogen groups. In particular, in order that the cured product could have rubber-like elasticity, it is more desirable that the component (F) has active hydrogen groups at the both terminals of the molecule.

The active hydrogen group noted above is not specifically defined. It may be active hydrogen itself, or may be in any form of hydroxyl group, amino group, carboxyl group or the like. In view of easy availability, preferred is hydroxyl group. However, in order that the stickiness of the cured product is desired to be smaller, amino group is preferred.

The repeating units that constitute the main chain of the component (F) are desirably oxyalkylene units or ester units in order that the hardness of the cured product could be low. For the repeating units, especially preferred are oxyalkylene units, more preferably oxypropylene units, in order that the hardness of the cured product for the elastic conductive layer could be low.

As specific examples of the component (F) in which the active hydrogen groups are hydroxyl groups and the repeating units of the main chain are oxyalkylene units, mentioned are polyoxyalkylene-polyols, which are used for producing the component (A-1) noted above and which are prepared by polymerizing a compound (starting compound) having at least 2 active hydrogens with a $C_{2-4}$ alkylene oxide. The polyoxyalkylene-polyols which are preferably used for producing the component (A-1) are also preferably used as the component (F) in the conductive composition (3).

As specific examples of the component (F) which has active hydrogen groups and in which the repeating units of the main chain are ester units, mentioned are polylactones such as ring-cleaved polymers of E-caprolactone, as well as polycondensates of polyoxyalkylene-polyols, dicarboxylic acids and low-molecular diols, etc.

Though differing from the component (F) noted above, polyols of polybutadienes, hydrogenated polybutadienes, polyisoprenes or the like (polyolefin-polyols) may also be used in place of or along with the component (F).

As specific examples of the component (G) of a compound having at least 2 isocyanate groups in the molecule, mentioned are toluene-diisocyanate (TDI), diphenylmethane-diisocyanate (MDI), hexamethylene-diisocyanate (HDI), xylylene-diisocyanate (XDI), hydrogenated xylylene-diisocyanate ($H_6$XDI), isophorone-diisocyanate (IPDI), tetramethylxylylene-diisocyanate (TMXDI), hydrogenated diphenylmethane-diisocyanate ($H_{12}$MDI) and the like, as well as prepolymer derivatives of these compounds. Of those, preferred are aliphatic diisocyanate compounds such as hexamethylene-diisocyanate, in order that the cured products could have a low hardness. These compounds may be used either singly or as combined.

The ratio of the curing agent of the component (G) to the component (F) is preferably such that the equivalent ratio of the isocyanate group in the component (G) to the hydroxyl group in the component (F) falls between 0.7/1.0 and 2.0/1.0, more preferably between 0.9/1.0 and 1.5/1.0, considering that the isocyanate group in the component (G) is unstable.

The polyurethanating catalyst of the component (H) may be any ordinary one, including, for example, organic tin compounds, tertiary amines, etc. The component (H) maybe used in an amount of from 0.01 to 1% or so, relative to the total amount of the components (F) and (G).

The component (D) in the composition (3) may be the same as that in the composition (1) noted above, and the description of its details is omitted herein.

The plasticizer which may be optionally added to the conductive composition (3) will act to lower the hardness of the cured product. However, the composition containing the plasticizer will bleed out in a higher degree than that not containing it. Therefore, the amount of the plasticizer, if added to the composition, may be preferably larger in order to more lower the hardness of the cured product, but may be preferably smaller in order to prevent the cured product from bleeding out. In general, the amount may be from 3 to 10% or so, relative to the total amount of the components (F), (G), (H) and (D).

As specific examples of the plasticizer, mentioned are phthalic acid-type plasticizers such as DOP, DBP, etc.; and polyether-type plasticizers such as PPG, PEG, etc.

The method of using the composition (3) in producing developing rollers may be the same as that of using the composition (1) or (2) noted above, and the description of its details is omitted herein.

In still another embodiment, a siloxane-type reactive organic material may be in the conductive composition for the elastic conductive layer of the developing roller of the invention. The conductive composition of this type is hereinunder referred to as conductive composition (4), which will be described in detail.

One preferred example of the conductive composition (4) that contains a siloxane-type reactive organic material is a curable composition consisting essentially of;

(I) a two-liquid type RTV silicone rubber, (J) a curing agent, (K) a curing catalyst, and optionally containing;

(D) a conductivity-imparting agent.

Another preferred example of the composition (4) is a curable composition consisting essentially of;

(L) a one-liquid type RTV silicone rubber, (M) a curing agent, (N) a curing catalyst, and optionally containing;

(D) a conductivity-imparting agent.

Where the volume resistivity of the conductive composition is intended to fall within a semiconductive range, the composition may not require the component (D).

The conductive composition comprising the components (I), (J), (K) and (D) cures uniformly in the surface and in the depth, and has good deep vulcanizability and good releasability, while that comprising the components (L), (M), (N) and (D) have good adhesiveness. Therefore, cured products having the characteristics of these two compositions of different types are preferred, and mixtures of the two compositions may be employed.

Where the two-liquid type RTV silicone rubber of the component (I) is one curable through addition reaction, it has an alkenyl group such as vinyl group or the like in the molecule, and the group reacts with the hydrosilyl group existing in the curing agent, whereby the composition cures, like the conductive compositions (1) and (2).

The two-liquid type RTV silicone rubber may be any ordinary one, and the curing agent for it may be a siloxane-type one of the curing agent (B) to be in the conductive compositions (1) and (2). The curing catalyst for it may also be the same as that to be used in the conductive compositions (1) and (2).

The one-liquid type RTV silicone rubber of the component (L) has a silanol group in the molecule, for which the curing agent (M) may be a compound having at least 2 hydrolyzable silyl groups. In that case, the silanol group as formed through hydrolysis of the hydrolyzable silyl group in the curing agent reacts with the silanol group in the one-liquid type RTV silicone rubber through dehydrating condensation, whereby the composition cures.

The one-liquid type RTV silicone rubber and the curing agent for it may be any ordinary ones. The curing catalyst for the reaction of these two includes, for example, organic tin compounds such as dibutyl tin dilaurate, dibutyl tin dimaleate, dioctyl tin dilaurate, dioctyl tin dimaleate, tin octylate, etc.; phosphoric acid and phosphates such as phosphoric acid, monomethyl phosphate, monoethyl phosphate, monobutyl phosphate, monooctyl phosphate, monodecyl phosphate, dimethyl phosphate, diethyl phosphate, dibutyl phosphate, dioctyl phosphate, didecyl phosphate, etc.; organic titanate compounds; organic aluminium compounds; saturated or unsaturated polycarboxylic acids and their anhydrides such as maleic acid and its anhydride; amines such as hexylamine, di-2-ethylhexylamine, N,N-dimethyldodecylamine, dodecylamine, etc.; reaction products of those amines and acidic phosphates, etc. Mixtures of those compounds are also preferably used, as having high activity.

To the conductive composition (4), optionally added is a filler, such as fumed silica, precipitated silica, hydrophobic silica, carbonblack, titaniumdioxide, ferricoxide, aluminium oxide, zinc oxide, quartz powder, diatomaceous earth, calcium silicate, talc, bentonite, asbestos, glass fiber, organic fiber, etc., for modulating the characteristics of the composition and for lowering the production costs. These fillers may be added either singly or as combined. Apart from the filler, any other additives may also be added to the composition either singly or as combined.

The method of using the composition (3) in producing developing rollers may be the same as that of using the composition (1) or (2) noted above, and the description of its details is omitted herein.

Still other curable compositions except the conductive compositions (1) to (4) noted above may be used for forming the elastic conductive layer, which will be described below. As the other compositions employable herein except the compositions (1) to (4) noted above, for example, mentioned are compositions comprising ethylene-propylene rubber such as NBR (nitrile rubber), SBR (styrene-butadiene rubber), CR (chloroprene rubber), EPDM or the like, or millable silicone rubber, to which is added a conductivity-imparting agent, and also those additionally containing any other additives. These compositions are thermoplastic ones, and differ from the thermosetting compositions noted above which cure to give rubber-like products. In these compositions, preferred are NBR and EPDM, as the hardness and the compression set of their cured products are well balanced when used in rollers.

The millable silicone rubber consists essentially of linear polyorganosiloxane (raw rubber) having a high degree of polymerization (6000 to 10000), and this is prepared by compounding the essential ingredient with a silica-type, reinforcing or vehicle filler, a dispersion promoter for the filler, and even other various additives such as heat resistance improver, internal lubricant, pigment, etc. The resulting rubber compound may be kneaded with an organic peroxide-type curing agent such as 2,4-dichlorobenzoyl peroxide or the like, and cured under heat. In general, the raw rubber has methylvinylsiloxane units.

Now, Examples of the invention are mentioned below along with Comparative Examples, which, however, are to concretely illustrate the invention but do not whatsoever restrict the scope of the invention.

EXAMPLES AND COMPARATIVE EXAMPLES (1) Formation of Developing Rollers

Any of the two types of elastic conductive layers mentioned below was combined with any of 8 types of surface layers shown in Table 1, in the manner as indicated in Table 2 to form developing rollers of Examples 1 to 7 and Comparative Examples 1 to 3. Precisely, in each developing roller, formed was an elastic conductive layer having a thickness of 7.5 mm around a stainless steel shaft having a diameter of 10 mm, and the outer surface of the conductive layer was covered with a surface layer formed thereover through dipping or coating followed by baking. Elastic Conductive Layer 1:

The following (A), (B), (C) and (D) were mixed and defoamed under reduced pressure (not higher than 10 mmHg, for 120 minutes).

(A) 100 parts by weight of allyl-terminated polyoxypropylene polymer having a number-average molecular weight (Mn) of 8,000 and a molecular weight distribution of 2;

(B) 6.6 parts by weight of polysiloxane-type curing agent (having an SiH value of 0.36 mols/100 g);

(C) 0.06 parts by weight of isopropyl alcohol solution of 10% chloroauric acid; and (D) 7 parts by weight of carbon black 3030B (manufactured by Mitsubishi Chemical).

The resulting mixture was applied onto the surface of a SUS shaft having a diameter of 10 mm, and cured in a mold at 120° C. for 30 minutes to form a conductive, elastic rubber layer having a thickness of 7.5 mm around the shaft. The hardness of this elastic conductive layer was measured according to the method A in JIS K 6301 using a JIS A hardness tester, and it s 14°.

Elastic Conductive Layer 2:

Using a composition comprised of 100 parts by weight of Good Year's Chemigum N683B (this is NBR rubber having a bonded acrylonitrile content of 33% and a Mooney viscosity of 28) and 5 parts by weight of ketjen black EC, formed was a conductive, rubber elastic layer having the same size as that of the elastic conductive layer 1. The JIS A hardness of this elastic conductive layer was measured to be 45°.

TABLE 1

| | Main Composition | Manufacturer | Trade Name | Contact Angle | Remarks (notes) |
|---|---|---|---|---|---|
| Surface Layer A | Ether-type urethane resin | Dainichi Seika | Himulen Y-237 | 48° | Resin was diluted 5-fold with DMF/CHN (1/2) solution (5% solid content). |
| Surface Layer B | Ether-type urethane resin | Dainichi Seika | Himulen NPU-5 | 40° | Resin was diluted 6-fold with DMF/MEK (4/1) solution (5% solid content). |
| Surface Layer C | Ether-type urethane resin | Dainichi Seika | Himulen Y-258 | 38° | Resin was diluted 5-fold with IPA/TOL (1/1) solution (5% solid content). |
| Surface Layer D | Fluorine resin/ether-type urethane resin = 2/1 | Central Glass/Dainichi Seika | Cefral Soft G180Y/Himulen Y-258 | 42° | Resin was diluted with DMF to have 5% solid content. |
| Surface Layer E | Fluorine resin/ether-type urethane resin = 1/1 | Central Glass/Dainichi Seika | Cefral Soft G180Y/Himulen Y-258 | 45° | Resin was diluted with DMF to have 5% solid content. |
| Surface Layer F | Hydrolyzable silyl group-having acrylic resin | Kanegafuchi Chemical | Zemlac YC-3623 | 35° | Resin was diluted with TOL to have 5% solid content. |
| Surface Layer G | Ester-type urethane resin | Mitsubishi Chemical | HET 1020 | 30° | Resin was diluted with TOL to have 5% solid content. |
| Surface Layer H | N-methoxymethylated nylon | En-ichi | EM-20 | 22° | Resin was diluted with MeOH to have 10% solid content. |

(Notes)
DMF: dimethylformamide, CHN: cyclohexanone, MEK: methyl ethyl ketone, IPA: isopropyl alcohol, TOL: toluene, MeOH: methanol Measurement of Contact Angle:

As the dripping liquid for the measurement of the contact angle of the resin composition for the surface layer, used was Polycizer W2380 (adipic acid-type, liquid polyester manufactured by Dai-Nippon Ink Chemical Industry KK, having a viscosity at 25° C. and 12 rpm of 3020 cps, an acid value of 0.1 mg/g, and an APHA color hue of 50). As the contact angle meter, used was CA-DT·A Model manufactured by Kyowa Kaimen Kagaku KK, and the injection needle for dripping the liquid was a 15-gauge one manufactured by Kyowa Kaimen Kagaku KK. The diameter of the drop of the liquid on a sample was about 1.5 mm in the dripping direction. The resin composition for the surface layer was applied onto the surface of a Cr-plated flat substrate to from a sample layer thereon. Five drops of the liquid were dripped onto one sample, and 30 seconds after the dripping, the contact angle between the sample surface and each drop was measured. Of the five data obtained, the largest one and the smallest one were omitted, and the averaged value of the remaining three data was rounded off to obtain the contact angle of the sample. The values of the contact angle thus obtained are shown in Table 2.

(2) Evaluation of Developing Rollers:

Each developing roller was built in a commercial 6-sheet printer. Using a polyester-containing toner in the printer, a copying test was carried out, in which was measured the initial solid black density of the image formed. After the printer was run continuously for 5 hours, the surface layer of the developing roller therein was visually checked for toner filming. In addition, after the 5 hours running test, the photoreceptor was checked for toner fogging on its surface in imaging (white). For this, an adhesive tape was stuck onto the photoreceptor and peeled off, and it was visually checked. Further, after the 5 hours running test, the amount of the toner having a grain size of not larger than 5 μm was measured. The data obtained are shown in Table 2.

TABLE 2

| | Roller Structure | | | Macbeth density (solid black) of | Filming | | Increase in |
|---|---|---|---|---|---|---|---|
| | Elastic Layer | Surface Layer | Contact Angle | Initial Image | Visual Observation of Roller Surface | Toner Fogging on Photoreceptor | Toner of not larger than 5 μm in size (note) |
| Example 1 | 1 | A | 48° | 1.45 | No | No | 5% |
| Example 2 | 1 | B | 40° | 1.45 | No | No | 5% |
| Example 3 | 2 | B | 40° | 1.4 | No | No | 15% |
| Example 4 | 1 | C | 38° | 1.3 | Yes, but a little | Yes, but a little | 5% |
| Example 5 | 1 | D | 42° | 1.3 | No | No | 5% |
| Example 6 | 1 | E | 45° | 1.4 | No | No | 5% |
| Example 7 | 1 | F | 35° | 1.3 | Yes, but a little | Yes, but a little | 5% |
| Comparative Example 1 | 1 | G | 30° | 1.3 | Yes | Yes, much | 5% |
| Comparative Example 2 | 1 | H | 22° | 1.4 | Yes | Yes, much | 8% |
| Comparative Example 3 | 2 | H | 22° | 1.4 | Yes | Yes, much | 17% |

(Note) The amount of the grains having a grain size of not larger than 5 μm in the initial toner was omitted.

From the data in Table 2, it is known that, when the surface layer of the developing roller is made from a resin composition, of which the contact angle with a drop of a liquid having a resin composition similar to that for the toner used for the development with the developing roller is not smaller than 35°, preferably not smaller than 38°, more preferably not smaller than 42°, such as that in the samples of Examples, toner filming on the developing roller can be evaded. As opposed to this, however, when the surface layer of the developing roller is made from a resin composition, of which the contact angle in question is smaller than 35°, as in the samples of Comparative Examples, significant toner filming occurs on the developing roller. In addition, when a polyester-type toner is used and when the developing roller used has a surface layer made from a resin composition consisting essentially of an ether-type urethane resin, the initial density of the images formed is good. Further, when the elastic conductive layer of the developing layer (this layer is the essential part of the developing roller) that underlies the surface layer is made of a cured product of the curable composition of the invention, toner cracking on the roller can be reduced.

According to the present invention, provided is a developing roller having a surface layer of a resin composition, of which the contact angle with a drop of a liquid having a resin composition similar to that for the toner used for the development with the developing roller is not smaller than 35°, preferably not smaller than 38°, more preferably not smaller than 42°. Using the developing roller, toner filming therearound is prevented, and the initial density of the images formed is good. In addition, where the elastic conductive layer of the developing roller is made of a soft and elastic, cured product of a curable composition in the invention, toner cracking on the roller can be reduced.

While the invention has been described in detail and with reference to specific embodiments thereof, it will be apparent to one skilled in the art that various changes and modifications can be made therein without departing from the spirit and scope thereof.

What is claimed is:

1. A developing roller to be employed in a developing device which is incorporated in electrophotographic apparatus such as duplicators, printers, receivers for facsimiles or the like, and in which toner carried on the surface of the roller being or not being kept in contact with a photoreceptor is transferred at least to the photoreceptor; the developing roller being characterized in that an elastic conductive layer is formed around the conductive shaft of the roller, that the outer surface of the elastic conductive layer is covered with a surface layer, and that the surface layer is formed from a resin composition of which the contact angle with a drop of a liquid consisting essentially of a component similar to the resin component constituting the toner to be used in the developing device is not smaller than 35°.

2. The developing roller as claimed in claim 1, wherein said contact angle is not smaller than 38°.

3. The developing roller as claimed in claim 1, wherein said contact angle is not smaller than 42°.

4. The developing roller as claimed in claim 1, wherein the toner used in said developing device is a polyester-containing toner, and said liquid is polyester.

5. The developing roller as claimed in claim 4, wherein the resin composition to form said surface layer consists essentially of a polyether skeleton-having urethane resin.

6. The developing roller as claimed in claim 4, wherein the resin composition to form said surface layer consists essentially of a mixture of a solvent-soluble fluorine-containing resin and an urethane resin.

7. The developing roller as claimed in claim 6, wherein said urethane resin is a polyether skeleton-having one.

8. The developing roller as claimed in claim 6, wherein said mixture is in a ratio of the solvent-soluble fluorine-containing resin to the urethane resin falling between 10/90 and 90/10.

9. The developing roller as claimed in claim 4, wherein the resin composition to form said surface layer consists essentially of a polymer which has hydrolyzable silyl groups in the molecule and in which the repeating units constituting the main chain are of an acrylic polymer or a saturated hydrocarbon polymer.

10. The developing roller as claimed in claim 1, wherein said elastic conductive layer is made of an elastic substance having a JIS A hardness of not larger than 30°.

11. The developing roller as claimed in claim 10, wherein said elastic conductive layer is made of a cured product of a curable composition which consists essentially of;

(A) a polymer having at least one alkenyl group in the molecule, in which the repeating units constituting the main chain are essentially oxyalkylene units or saturated hydrocarbon units, (B) a curing agent having at least 2 hydrosilyl groups in the molecule, (C) a hydrosilylating catalyst, and optionally contains;

(D) a conductivity-imparting agent.

12. A developing roller to be employed in a developing device which is incorporated in electrophotographic apparatus such as duplicators, printers, receivers for facsimiles or the like, and in which toner carried on the surface of the roller being or not being kept in contact with a photoreceptor is transferred at least to the photoreceptor; the developing roller being characterized in that an elastic conductive layer is formed around the conductive shaft of the roller, that the outer surface of the elastic conductive layer is covered with a surface layer, and that the surface layer is formed from a resin composition of which the contact angle with a drop of a liquid consisting essentially of a component similar to the resin component constituting the toner to be used in the developing device is not smaller than 35°, the toner used in said developing device is a polyester-containing toner, and said liquid is oleic acid type polyester having a viscosity at 25° C. and at 12 rpm of from 2700 to 3200 cps, an acid value of from 0.1 to 0.3 mg/g, and an APHA color hue of from 30 to 100.

13. The developing roller as claimed in claim 12, wherein said contact angle is not smaller than 42°.

14. The developing roller as claimed in claim 12, wherein the toner used in said developing device is a polyester-containing toner, and said liquid is polyester.

15. The developing roller as claimed in claim 12, wherein said elastic conductive layer is made of an elastic substance having a JIS A hardness of not larger than 30°.

16. A developing roller to be employed in a developing device which is incorporated in electrophotographic apparatus such as duplicators, printers, receivers for facsimiles or the like, and in which toner carried on the surface of the roller being or not being kept in contact with a photoreceptor is transferred at least to the photoreceptor; the developing roller being characterized in that an elastic conductive layer is formed around the conductive shaft of the roller, that the outer surface of the elastic conductive layer is covered with a surface layer, and that the surface layer is formed from a resin composition of which the contact angle with a drop of a liquid consisting essentially of a component similar to the resin component constituting the toner to be used in the developing device is not smaller than 35°, wherein the toner used in said developing device is a styrene-acrylic resin-containing toner, and said liquid is butyl acrylate.

17. The developing roller as claimed in claim 16, wherein the resin composition to form said surface layer consists essentially of a polyether skeleton-having urethane resin.

18. The developing roller as claimed in claim 16, wherein the resin composition to form said surface layer consists essentially of a mixture of a solvent-soluble fluorine-containing resin and an urethane resin.

19. The developing roller as claimed in claim 18, wherein said mixture is in a ratio of the solvent-soluble fluorine-containing resin to the urethane resin falling between 10/90 and 90/10.

20. The developing roller as claimed in claim 18, wherein said urethane resin is a polyether skeleton-having one.

21. The developing roller as claimed in claim 16, wherein the resin composition to form said surface layer consists essentially of a polymer which has hydrolyzable silyl groups in the molecule and in which the repeating units constituting the main chain are of a saturated hydrocarbon polymer.

22. The developing roller as claimed in claim 16, wherein said contact angle is not smaller than 38°.

23. The developing roller as claimed in claim 16, wherein said contact angle is not smaller than 42°.

24. The developing roller as claimed in claim 16, wherein said elastic conductive layer is made of an elastic substance having a JIS A hardness of not larger than 30°.

* * * * *